US005180879A

United States Patent [19]

Simon et al.

[11] Patent Number: 5,180,879

[45] Date of Patent: Jan. 19, 1993

[54] AMMUNITION SUPPLY DEVICE FOR AN AUTOMATIC WEAPON

[75] Inventors: Georges H. Simon, Saint Germain du Puy; Patrice J. Pichot; Alain J. M. Boissau, both of Bourges, all of France

[73] Assignee: Giat Industries, France

[21] Appl. No.: 779,833

[22] Filed: Oct. 21, 1991

[30] Foreign Application Priority Data

Jul. 12, 1990 [FR] France ..... 90 08872

[51] Int. Cl.[5] ..... F41A 9/20

[52] U.S. Cl. ..... 89/33.17; 89/34; 193/25 AC

[58] Field of Search ..... 89/33.01, 33.1, 33.17, 89/33.02, 34, 11, 33.16; 193/25 AC

[56] References Cited

U.S. PATENT DOCUMENTS

| | | | |
|---|---|---|---|
| 1,552,862 | 9/1925 | Methlin | 89/33.01 |
| 3,563,357 | 2/1971 | West | 193/25 AC |
| 4,270,436 | 6/1981 | Bishop et al. | 89/33.01 |
| 4,474,102 | 10/1984 | Tassie | 89/33.17 |
| 4,869,150 | 9/1989 | Post et al. | 89/33.01 |

FOREIGN PATENT DOCUMENTS

| | | | |
|---|---|---|---|
| 1965145 | 7/1970 | Fed. Rep. of Germany . | |
| 584268 | 1/1947 | United Kingdom . | |
| 1337388 | 11/1973 | United Kingdom | 89/33.02 |

*Primary Examiner*—Stephen M. Johnson
*Attorney, Agent, or Firm*—Parkhurst, Wendel & Rossi

[57] ABSTRACT

The invention relates to an ammunition supply device for an automatic weapon that undergoes translational motion in relation to a fixed magazine. It comprises at least one slide fitted with gripping devices (9) for ammunition (11), and primary guide mechanisms (12,13) to bring the slide from a longitudinal position that is random in relation to the weapon to a longitudinal position that is predetermined in relation to the weapon.

5 Claims, 2 Drawing Sheets

AMMUNITION SUPPLY DEVICE FOR AN AUTOMATIC WEAPON

BACKGROUND OF THE INVENTION

Field of the Invention

The present invention relates to a device for feeding ammunition to an automatic weapon that undergoes translational motion in relation to a fixed ammunition magazine. The problem posed consists in bringing ammunition from a storage point in an ammunition magazine that is fixed in relation to the carriage of the weapon, to the weapon, which undergoes longitudinal translational motion due to recoil.

This problem is posed in a particularly acute fashion in automatic weapons with floating firing in which the feeding and the ignition are performed before the recoiling part of the weapon has regained its neutral position. In fact, in this type of weapon, no fixed reference point in the longitudinal direction is provided, i.e. in the recoil direction of the weapon.

SUMMARY OF THE INVENTION

The present invention aims to provide a feeding device that enables ammunition to be brought into the firing position from the fixed magazine.

Therefore, the object of the present invention is a device for feeding ammunition to an automatic weapon that undergoes a translational motion (e.g. during recoil) in relation to a fixed magazine, including at least one slide fitted with gripping devices for a piece of ammunition and primary guiding mechanisms to bring the slide from a longitudinal position that is random in relation to the weapon to a longitudinal position that is predetermined in relation to the weapon.

Advantageously, secondary guiding mechanisms are also provided for bringing the slide from a longitudinal position that is random in relation to the magazine to a longitudinal position that is predetermined in relation to the magazine, so that the slide is cyclically brought back from its weapon feeding position to the fixed ammunition magazine.

In a particular embodiment of the invention, the primary guiding mechanisms comprise a ramp and a counter ramp that are rigid with the weapon, and which gradually get closer from the magazine to the weapon, and a roller mounted on the slide in order to move between the two ramps, the longitudinal distance between the ramp and the counter ramp at the weapon being approximately the same as the diameter of the roller.

Similarly, the secondary guiding mechanisms may comprise a ramp and a counter ramp that are rigid with the magazine, and which gradually get closer from the weapon to the magazine and a roller mounted on the slide in order to move between the two ramps, the longitudinal distance between the ramp and the counter ramp at the magazine being approximately the same as the diameter of the roller.

Of course, the same roller may be used for the primary and secondary guiding mechanisms.

Each ramp combined with its respective counter-ramp consequently acts like a funnel, the slide's roller being disposed between the ramp and the counter-ramp in a random longitudinal position and being brought to a predetermined position either in relation to the weapon or the magazine, depending on the phase of the cycle (i.e., either the feeding phase) or the return to the magazine phase.

The device may comprise, in a known way, supply devices in an arc of a circle. The slides are, according to the invention, arranged on a mounted barrel that rotates around the axis of the arc.

In the latter case, the ramps may be helicoidal ramps with the counter ramps being circular.

The feeding devices may comprise, for example, numerous mounted star arms that rotate around the axis of the circular arc.

Also according to the invention, at least one pusher finger may be provided to bring the ammunition from its predetermined longitudinal position to its firing position.

BRIEF DESCRIPTION OF THE DRAWINGS

By way of example, a non-exhaustive particular embodiment of the invention will now be described with reference to the diagrammatic drawings appended in which.

DETAILED DESCRIPTION OF THE PREFERRED EMBODIMENTS

Figure 1:
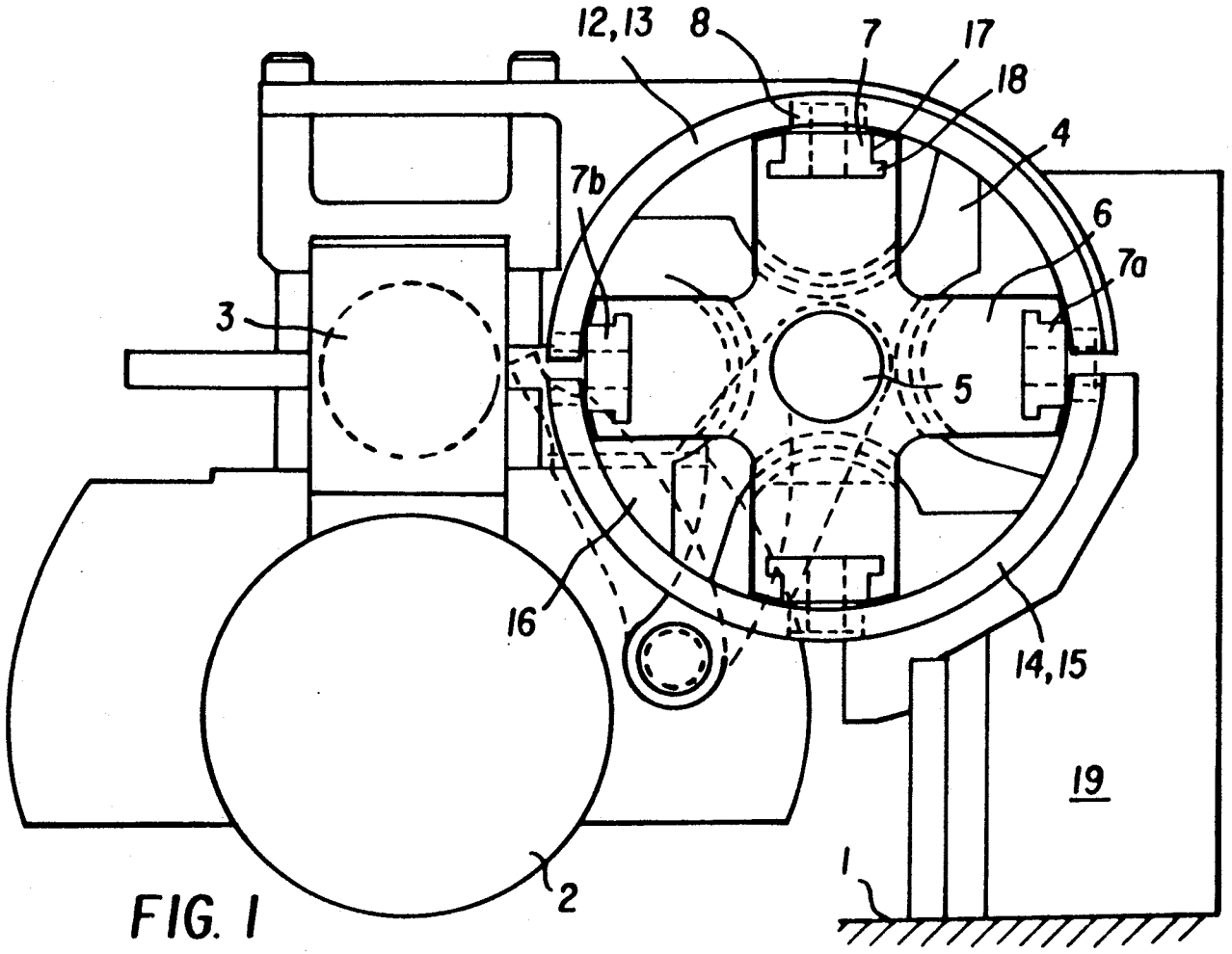
FIG. 1 is an elevation view of a device according to the invention.
Figure 2B:
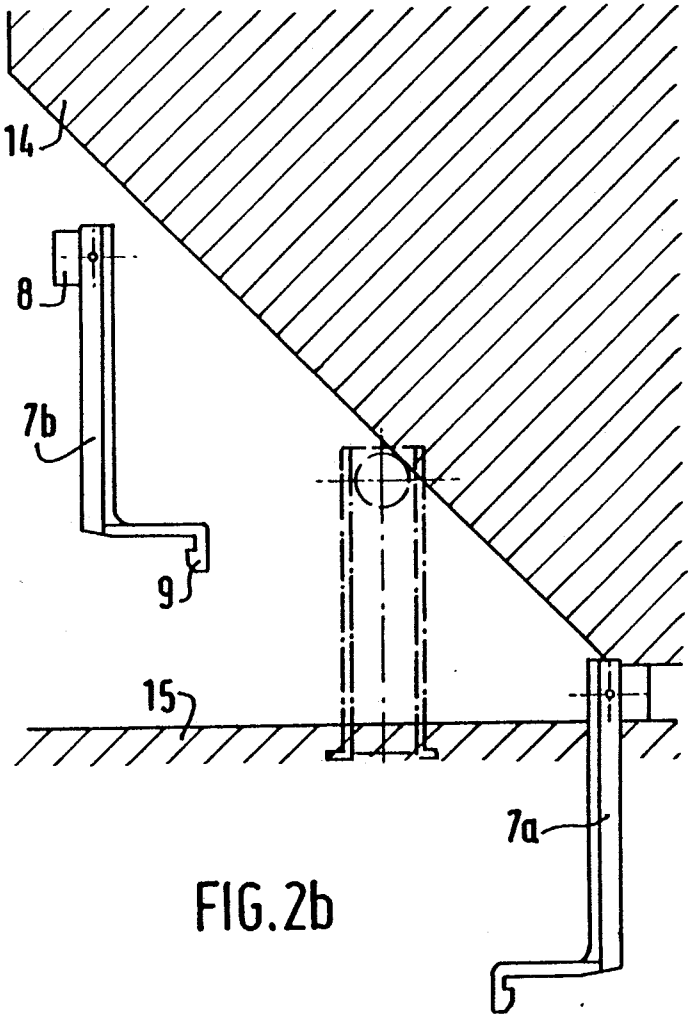
FIGS. 2*a* and 2*b* represent the ramps and the slides of this device in a detailed view.
Figure 2A:
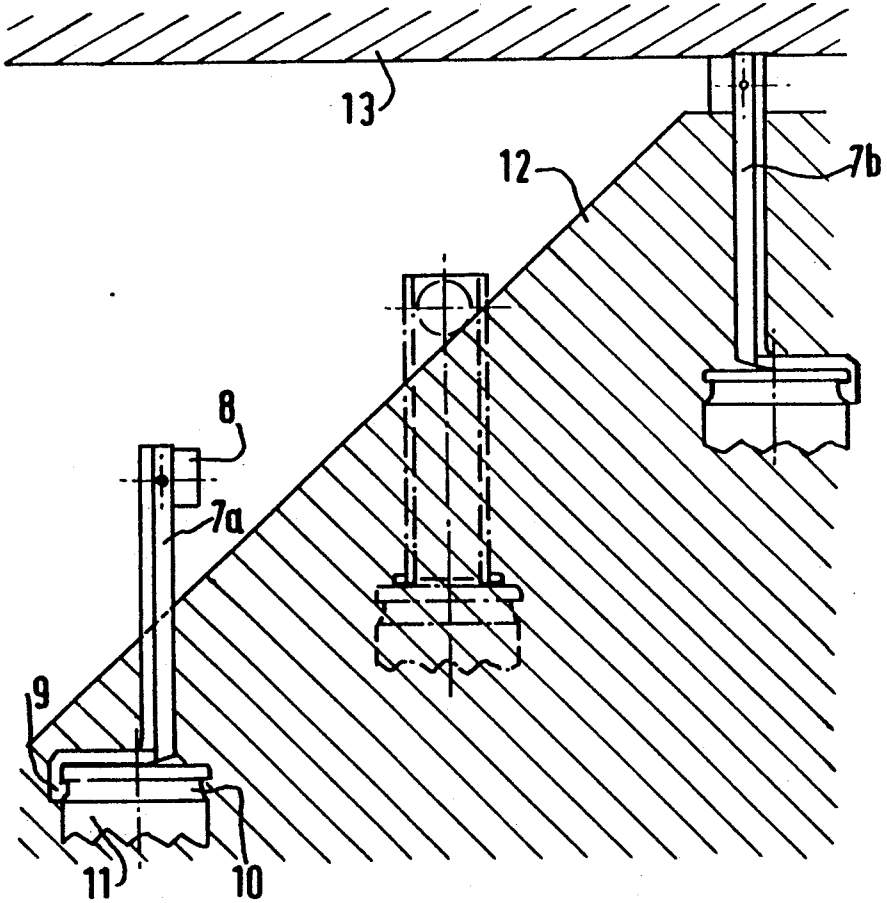

FIG. 1 represents a weapon comprising a fixed carriage with the symbol reference number 1, a control screw 2 for the breech 3, and a star arm assembly 4 enabling the breech 3 to be supplied with ammunition from a fixed magazine 19 that is rigid with the carriage 1.

The shaft 5 for mounting the star arms 4 also supports a barrel 6 on which are slidably mounted four slides 7 that slide in a longitudinal direction via longitudinal ribs 18 of slides 7 and cooperable longitudinal protrusions 17 of barrel 6.

Each slide 7 includes, at one end a roller 8 whose axis is perpendicular to the axis of the shaft 5, and at the other end, a hook-shaped projection 9 that can engage in a groove 10 in the casing of a piece of ammunition 11.

The device according to the invention also comprises a helicoidal ramp 12 and a circular ramp 13 that are rigid with the recoiling part of the weapon, as well as a helicoidal ramp 14 and a circular counter ramp 15 that are rigid with the fixed carriage 1.

The ramps 12 and 13 get closer together from the magazine to the weapon, and in the same way, the ramps 14 and 15 get closer together from between the weapon and the magazine.

The final distance between ramps 12 and 13, to between 14 and 15 is approximately the same as the diameter of rollers 8, so that when a slide 7 arrives at the end of its run between ramps 12 and 13, it is in a specified position in relation to the weapon. Similarly, when slide 7 arrives at the end of its run between ramps 14 and 15, it is in a specified position in relation to the magazine.

Shaft 5 drives the star arms 4 and barrel 6 at the same time.

Slide 7*a* situated opposite the breech 3 extracts a piece of ammunition at the magazine. At that moment, it is in a random longitudinal position in relation to the weapon.

At a given moment of the rotation, its roller 8 comes into contact with the ramp 12 which brings it into position 7*b* where it is positioned longitudinally in relation to the weapon. In this position, a pusher finger 16 brings the ammunition into the center of the breech 3.

The longitudinal position *7b* is random in relation to the ammunition magazine. Rotation of the barrel 6 then brings it into contact with ramp 14 that is rigid with the carriage 1 of the weapon. Slide 7 is driven along ramp 14, bringing it finally in position *7a* which is specified longitudinally in relation to the magazine where it may extract another piece of ammunition.

The device according to the invention consequently enables ammunition to be brought from the fixed magazine to the travelling weapon using slides 7, then to bring these back to the magazine, irrespective of the relative positions of the magazine and the weapon.

Different variations and modifications may be made to the description above without, however, departing from the scope or the spirit of the invention.

We claim:

1. A device for feeding ammunition from a stationary magazine to an automatic weapon, comprising:

a barrel mounted on a rotatable shaft having a longitudinal axis;

at least one slide longitudinally slidably supported by said barrel, said at least one slide having gripping means for carrying a round of ammunition to a breech of said weapon from a predetermined position;

an ammunition supply device mounted on said rotatable shaft to supply ammunition from said magazine to said predetermined position;

a roller fixed to said at least one slide;

primary guide means for positioning said at least one slide at a predetermined longitudinal position with respect to said weapon from a random longitudinal position with respect to said weapon, said primary guide means comprising a first ramp and a first counter ramp fixed to a recoiling part of the weapon, a distance between said first ramp and said first counter ramp decreasing towards said breech of said weapon to a length approximately equal to a diameter of said roller, said roller cooperable with said ramp and counter ramp to guide said at least one slide towards said breech;

secondary guide means for positioning said at least one slide at a predetermined longitudinal position with respect to said magazine from a random longitudinal position with respect to said magazine, said secondary guide means comprising a second ramp and a second counter ramp fixed to said magazine, a distance between said second ramp and said second counter ramp decreasing towards said magazine to a length approximately equal to a diameter of said roller, said roller cooperable with said second ramp and said second counter ramp to guide said at least one slide towards said magazine.

2. The device of claim 1, wherein said primary and secondary guide means each extend 180° and are disposed opposite of each other to form a circular path for said slide.

3. The device of claim 1, wherein said first and second ramps are helicoidal and said first and second counter ramps are circular.

4. The device of claim 1, wherein said ammunition supply device comprises at least one star arm rotatable about said longitudinal axis of said shaft.

5. The device of claim 1, further comprising at least one pushing finger for bringing said ammunition round from said predetermined longitudinal position with respect to said weapon to a firing position.

* * * * *